US005770339A

United States Patent [19]

Nukada et al.

[11] Patent Number: 5,770,339

[45] **Date of Patent: *Jun. 23, 1998**

[54] ELECTROPHOTOGRAPHIC PHOTORECEPTOR USING CHARGE TRANSPORTING COPOLYESTER

[75] Inventors: Katsumi Nukada; Akira Imai; Masahiro Iwasaki, all of Minami Ashigara, Japan

[73] Assignee: Fuji Xerox Co., Ltd., Tokyo, Japan

[ * ] Notice: The term of this patent shall not extend beyond the expiration date of Pat. No. 5,604,064.

[21] Appl. No.: 542,831

[22] Filed: Oct. 13, 1995

[30] Foreign Application Priority Data

| | | | |
|---|---|---|---|
| Oct. 18, 1994 | [JP] | Japan | 6-277233 |
| Dec. 6, 1994 | [JP] | Japan | 6-329854 |
| Jul. 11, 1995 | [JP] | Japan | 7-197159 |

[51] Int. Cl.[6] ..... G03G 5/047

[52] U.S. Cl. ..... 430/59

[58] Field of Search ..... 430/59

[56] References Cited

U.S. PATENT DOCUMENTS

| | | | |
|---|---|---|---|
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 4,937,165 | 6/1990 | Ong et al. | 430/59 |
| 4,959,288 | 9/1990 | Ong et al. | 430/59 |
| 4,983,482 | 1/1991 | Ong et al. | 430/59 |
| 5,034,296 | 7/1991 | Ong et al. | 430/59 |
| 5,080,989 | 1/1992 | Gruenbaum | 430/58 |
| 5,149,609 | 9/1992 | Yu et al. | 430/58 |
| 5,356,743 | 10/1994 | Yanus et al. | 430/59 |
| 5,604,064 | 2/1997 | Nukada et al. | 430/59 |

FOREIGN PATENT DOCUMENTS

| | | |
|---|---|---|
| 59-28903 | 7/1984 | Japan . |
| 61-20953 | 1/1986 | Japan . |

(List continued on next page.)

OTHER PUBLICATIONS

Daiyonpan Jikken Kagaku Koza (Experimental Chemistry Lecture, the 4th edition), vol. 28.

Fujii et al., "Organic EL Device Using Evaporated Polymer Film as Hole Transport Layer" from the 36th Meeting of Applied Physics Related Association, 31p–K–12 (1990), p. 1044.

(List continued on next page.)

*Primary Examiner*—Roland Martin

*Attorney, Agent, or Firm*—Oliff & Berridge, PLC

[57] ABSTRACT

An organic electronic device which comprises a layer including at least one charge transporting copolyester containing at least two repeating structural units selected from the group consisting of the structures represented by formulae (I-a) and (I-b) as partial structures:

(I-a)

(I-b)

wherein $R_1$ and $R_2$ each independently represents a hydrogen atom, an alkyl group, an alkoxy group, a substituted amino group, a halogen atom, or a substituted or unsubstituted aryl group; X represents a substituted or unsubstituted divalent aromatic group; n is an integer of from 1 to 5; and k is an integer of 0 or 1.

7 Claims, 1 Drawing Sheet

FOREIGN PATENT DOCUMENTS

| | | |
|---|---|---|
| 1-134456 | 5/1989 | Japan . |
| 1-134457 | 5/1989 | Japan . |
| 1-134462 | 5/1989 | Japan . |
| 4-133065 | 5/1992 | Japan . |
| 4-133066 | 5/1992 | Japan . |
| 4-189873 | 7/1992 | Japan . |
| 5-43813 | 2/1993 | Japan . |
| 5-80550 | 4/1993 | Japan . |
| 5-98181 | 4/1993 | Japan . |
| 5-140472 | 6/1993 | Japan . |
| 5-140473 | 6/1993 | Japan . |
| 5-263007 | 10/1993 | Japan . |
| 5-279591 | 10/1993 | Japan . |
| 6-219599 | 8/1994 | Japan . |

OTHER PUBLICATIONS

Murtl et al., "Charge Transport Polymers Based on Triphenylamine and Tetraphenylbenzidine Moieties" from the Proceedings of The Sixth International Congress on Advances in Non–Impact Printing Technologies, Oct. 1990, pp. 306–311.

ELECTROPHOTOGRAPHIC PHOTORECEPTOR USING CHARGE TRANSPORTING COPOLYESTER

FIELD OF THE INVENTION

This invention relates to an organic electronic device using a novel charge transporting copolyester and particularly to an electrophotographic photoreceptor using the novel charge transporting copolyester.

BACKGROUND OF THE INVENTION

Charge transporting polymers typified by polyvinylcarbazole (PVK) are promising as photoconductive materials for electrophotographic photoreceptors, and as organic electroluminescence device materials as described in the proceedings of the 36th Meeting of Applied Physics Related Association, 31 p-K-12 (1990). These polymers have a layer forming ability and are used as a charge transporting layer. As the materials which can form a charge transporting layer, charge transporting polymers typified by PVK and low molecular weight disperse systems comprising a low molecular weight charge transporting material dispersed in a polymer have been well-known. In the organic electroluminescence device, it is general that a low molecular weight charge transporting material is deposited to be used. Of these, low molecular weight disperse systems are mainstream in electrophotographic photoreceptor for their broad choice of material and high functions. While the recent advancement of performance of organic photoreceptors has made them applicable to high-speed copying machines and printers, state-of-the-art organic photoreceptors are not necessarily sufficient in terms of performance when applied to high-speed copying machines or printers. In particular, improvement in durability of organic photoreceptors has been strongly demanded.

One of the important factors which decide the durability of organic photoreceptor is abrasion resistance of a charge transporting layer. The low molecular weight disperse system charge transporting layer which is recent mainstream has satisfactory performance in terms of electrical characteristics, but because it is used by dispersing a low molecular weight substance in a polymer, it is disadvantageous in that it is substantially weak with regard to mechanical abrasion resistance. In the case of organic electroluminescence device, a low molecular weight charge transporting material tends to melt due to generated Joule heat and to crystallize, which cause morphologic changes of the film.

On the other hand, charge transporting polymers have been studied with expectation of eliminating the above-mentioned disadvantages. Examples of charge transporting polymers proposed to date include polycarbonate prepared from a specific dihydroxiarylamine and a bischloroformate, disclosed in U.S. Pat. No. 4,806,443; polycarbonate prepared from a specific dihydroxyarylamine and phosgene, disclosed in U.S. Pat. No. 4,806,444; polycarbonate prepared from a bishydroxyalkylarylamine and a bischloroformate or phosgene, disclosed in U.S. Pat. No. 4,801,517; polycarbonate prepared from a specific dihydroxyarylamine or a bishydroxyalkylarylamine and a bischloroformate or polyester prepared from the former monomer and a bisacyl halide, disclosed in U.S. Pat. Nos. 4,937,165 and 4,959,288; polycarbonate or polyester of an arylamine having a specific fluorene skeleton, disclosed in U.S. Pat. No. 5,034,296; polyurethane disclosed in U.S. Pat. No. 4,983,482; and polyester comprising a specific bisstyrylbisarylamine as a main chain, disclosed in JP-B-59-28903 (the.term "JP-B" as used herein means an "examined published Japanese patent application"). Further, JP-A-61-20953, JP-A-1-134456, JP-A1-134457, JP-A-1-134462, JP-A-4-133065, and JP-A-4-133066 (the term "JP-A" as used herein means an "unexamined published Japanese patent application") propose polymers having as a pendant group a charge transporting substituent, such as a hydrazone residue or a triarylamine residue, and photoreceptors containing the same. In particular, polymers having a tetraarylbenzidine skeleton exhibit high hole mobility and have high practical utility as reported in *The 6th International Congress on Advances in Non-impact Printing Technologies,* 306 (1990).

Charge transporting polymers require various characteristics such as solubility, mobility, and matching of oxidation potential, and in order to satisfy these requirements, physical properties are generally controlled by introducing a substituent. Since the ionization potential of charge transporting polymers is substantially decided by the charge transporting monomer, it is important that the ionization potential of the charge transporting monomer can be controlled. The monomeric raw materials for the previously described triarylamine polymers are roughly classified into two types, i.e., (1) those containing two hydroxyphenyl groups and (2) those containing two hydroxyalkylphenyl groups. However, those containing two hydroxyphenyl groups, which take an aminophenol structure are easily oxidized and, thus, it is difficult to be purified. Particularly, in the case of the parahydroxy structure, the monomer is more instable, and it is difficult to change the position of the substituent so as to control the ionization potential. Furthermore, since the monomers have a structure where the oxygen is directly substituted on the aromatic ring, the charge distribution tends to be unbalanced due to their electron-withdrawing property, mobility is disadvantageously decreased. In those containing two hydroxyalkylphenyl groups, although there is no influence upon the electron-withdrawing property because of intervening a methylene group, synthesis of the monomer is difficult. That is, in the reaction of the diarylamine or diarylbenzidine with 3-bromoiodebenzene, since both bromine and iodine have reactivity, the product tends to be a mixture, resulting in decreased yield. An alkyl lithium which is used for lithiation of bromine, and ethylene oxide have the disadvantage that they are highly dangerous and toxic, and care should be taken to deal with them.

As means for solving these problems, some of the present inventors have already disclosed novel charge transporting polymers in Japanese patent Application 6-219599. These charge transporting polymers were sufficient for achieving the intended objects. However, since they are homopolymers comprising a single molecular structure, it is difficult to control all of the physical properties such as solubility, mobility, and matching of oxidation potential at desired levels. That is, for example, when ionization potential is decreased and charge injection from the charge generating material is accelerated, the resistance to the oxidizing gas generated during the corona discharge is decreased, resulting in deteriorating the electrical characteristics. As a result of our study for a process for freely controlling the desired physical properties without sacrificing any other characteristics, it has been found that when a plurality of monomers having different physical properties are copolymerized into a copolymer, the problems associated with the homopolymers can be solved.

SUMMARY OF THE INVENTION

An object of the present invention is, therefore, to provide an organic electronic device using a novel charge transporting copolyester which has high solubility and film-forming ability, and whose desired ionization potential can be freely controlled, and which can easily be synthesized.

Another object of the present invention is to provide an electrophotographic photoreceptor using the novel charge transporting copolyester.

As a result of extensive investigations in light of the above disadvantages, the inventors of the present invention have found that a charge transporting copolyester containing at least two repeating structural units selected from the structures represented by the following formulae (I-a) and (I-b) has excellent charge transporting property and mechanical abrasion resistance, and an organic electronic device, particularly electrophotographic photoreceptor, using the same can realize high durability, thereby achieving the present invention.

The organic electronic device of the present invention comprises at least one charge transporting copolyester containing at least two repeating structural units selected from the structures represented by the following formulae (I-a) and (I-b).

(I-a)

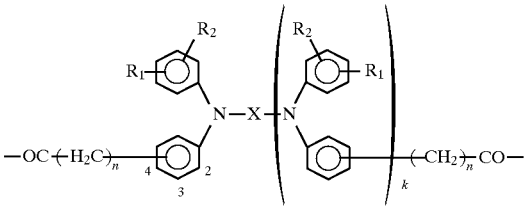

(I-b)

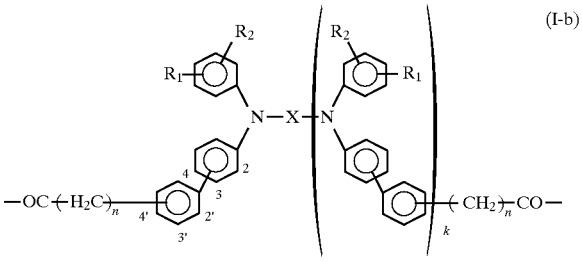

wherein $R_1$ and $R_2$ are independently a hydrogen atom, an alkyl group (preferably having 1 to 4 carbon atoms), an alkoxy group (preferably having 1 to 4 carbon atoms), a substituted amino group (preferably having 1 to 4 carbon atoms; e.g., alkyl-substituted amino group such as dimethylamino group and diethylamino group), a halogen atom, or a substituted or unsubstituted aryl group (e.g., an aryl group having 6 to 12 carbon atoms, which may be substituted with an alkyl group (preferably having 1 to 4 carbon atoms) or an alkoxy group (preferably having 1 to 4 carbon atoms)), X is a substituted or unsubstituted divalent aromatic residue, n is an integer of from 1 to 5, k is an integer of 0 or 1.

A preferable charge transporting copolyester in the present invention comprises:

(1) at least two repeating structural units selected from the repeating structural units represented by formulae (I-a) and (I-b) as dibasic carboxylic acid components and a repeating structural unit represented by formula (III) as a dihydric alcohol component, wherein the charge transporting copolymer has terminal groups each represented by formula (IV-a) or (IV-b), and has a polymerization degree of from 5 to 5,000; or (2) at least two repeating structural units selected from the repeating structural units represented by formulae (I-a) and (I-b), and a repeating structural unit represented by formula (II) as dibasic carboxylic acid components; and a repeating structural unit represented by formula (III) as a dihydric alcohol component, wherein the charge transporting copolymer has terminal groups each represented by formula (IV-a) or (IV-b), and has a polymerization degree of from 5 to 5,000:

(I-a)

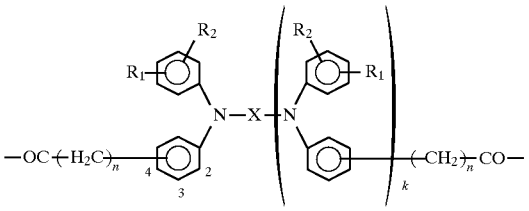

(I-b)

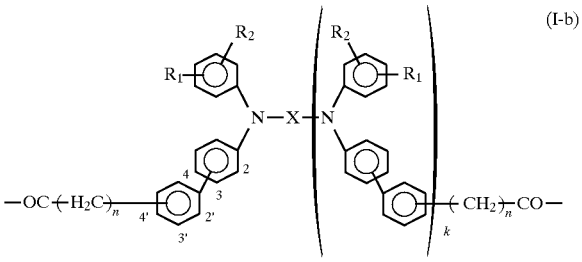

—OC—Z—CO— (II)

—O—(Y—O)$_m$— (III)

—O—(Y—O)$_m$—R (IV-a)

—O—(Y—O)$_m$—CO—Z—CO—OR' (IV-b)

wherein $R_1$ and $R_2$ are independently a hydrogen atom, an alkyl group, an alkoxy group, a substituted amino group, a halogen atom or a substituted or unsubstituted aryl group; X is a divalent substituted or unsubstituted aromatic residue; Z is a divalent carboxylic acid residue; R and R' are independently a hydrogen atom, an alkyl group, a substituted or unsubstituted aryl group (as R', preferred are an unsubstituted aryl group, and an aryl group substituted by an alkyl group (preferably having 1 to 4 carbon atoms such as methyl or ethyl)), or a substituted or unsubstituted aralkyl group (e.g., an aralkyl group which may be substituted by an alkyl group (preferably having 1 to 4 carbon atoms) or an alkoxy group (preferably having 1 to 4 carbon atoms)); Y is a divalent alcohol residue; n is an integer of from 1 to 5; k is an integer of 0 or 1; and m is an integer of from 1 to 5.

DETAILED DESCRIPTION OF THE INVENTION

Figure 1:
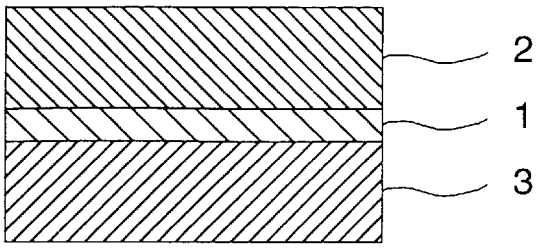
FIGS. 1 (*a*) to 1 (*f*) is each a schematically cross-sectional view of an electrophotographic photoreceptor of the present invention.
Figure 1:
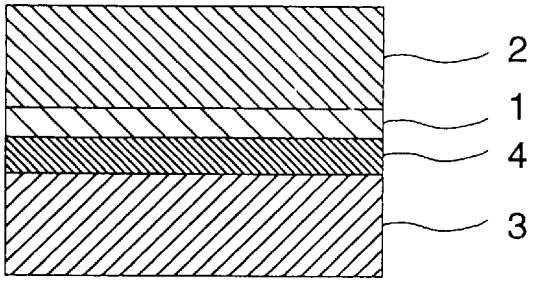
Figure 1:
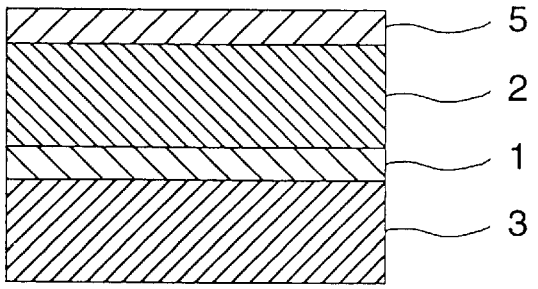
Figure 1:
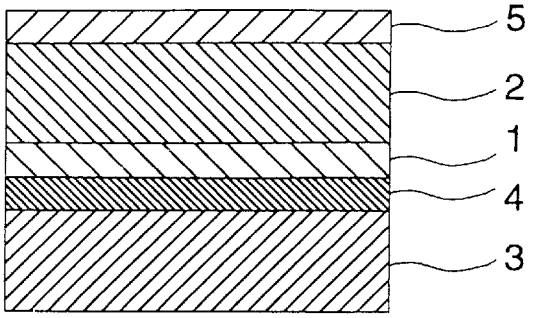
Figure 1:
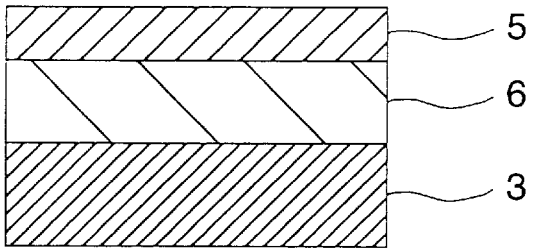
Figure 1:
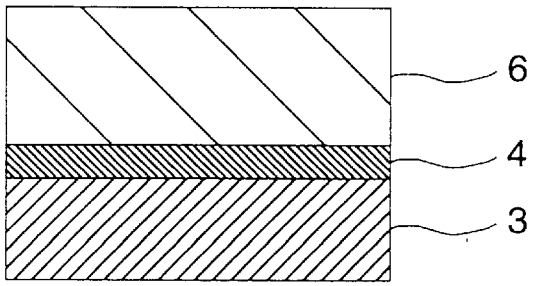

The present invention will now be described in detail.

In the present invention, preferred examples of "substituent" in the expression "substituted or unsubstituted" generally include an alkyl group (e.g., methyl or ethyl) and an alkoxy group (e.g., methoxy or ethoxy).

In formulae (I-a), (I-b), (II), and (III), examples of X, Y, and Z are as follows:

As X, those selected from the following groups (1) to (7) may be used.

(1)

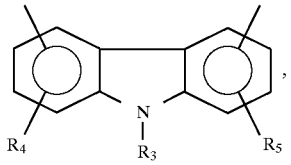

-continued (2)

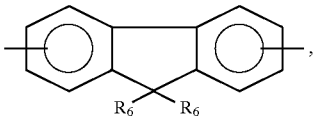

(3)

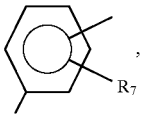

(4)

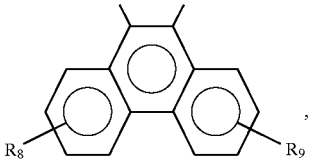

(5)

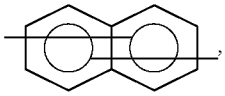

(6)

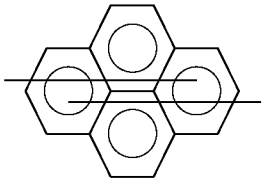

(7)

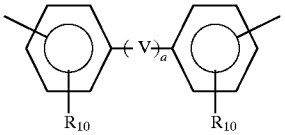

wherein $R_3$ is a hydrogen atom, an alkyl group having 1 to 4 carbon atoms, a substituted or unsubstituted phenyl group, or a substituted or unsubstituted aralkyl group; $R_4$ to $R_{10}$ are independently a hydrogen atom, an alkyl group having 1 to 4 carbon atoms, an alkoxy group having 1 to 4 carbon atoms, a substituted or unsubstituted phenyl group, a substituted or unsubstituted aralkyl group, or a halogen atom; a is 0 or 1; and V is the group selected from the following groups (8) to (17):

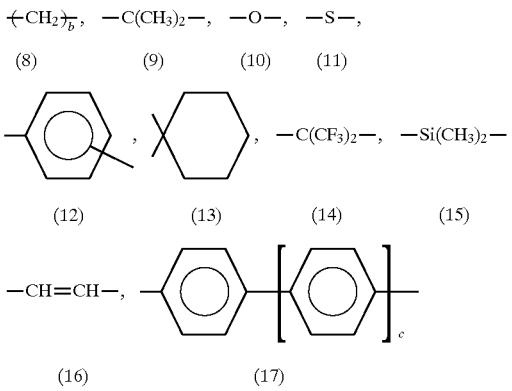

wherein b is an integer of from 1 to 10, and c is an integer of from 1 to 3.

Y and Z are the groups selected from the following groups (18) to (24):

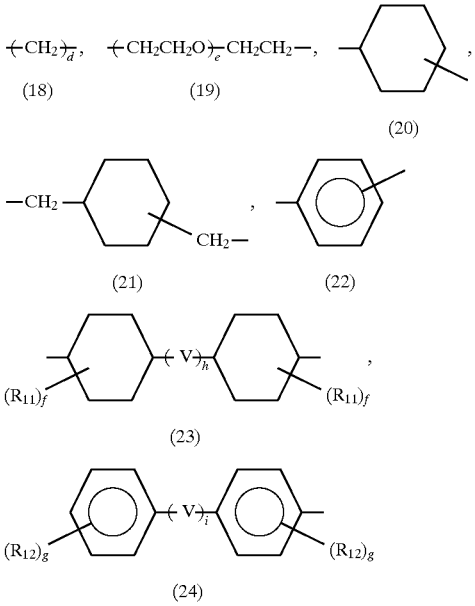

wherein $R_{11}$ and $R_{12}$ are independently a hydrogen atom, an alkyl group having 1 to 4 carbon atoms, an alkoxy group having 1 to 4 carbon atoms, a substituted or unsubstituted phenyl group, a substituted or unsubstituted aralkyl group, or a halogen atom; d and e are independently an integer of from 1 to 10; f and g are independently an integer of 0, 1, or 2; h and i are independently 0 or 1; and V has the same meaning as described above.

Examples of a substituent for the divalent aromatic residue of X include those in groups (1) to (7) mentioned above, preferably those of $R_4$ to $R_{10}$, more preferably an alkyl group or an alkoxy group.

The polymerization degree, p, of the charge transporting polymer of the present invention is from 5 to 5,000, and preferably from 10 to 3,000, more preferably 15 to 1,000. The weight average molecular weight, $M_w$, is preferably from 10,000 to 300,000.

Of these, those having a biphenyl structure represented by formulae (V-a) or (V-b) as X are preferable, because they have excellent characteristics such as mobility.

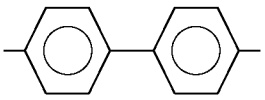

(V-a)

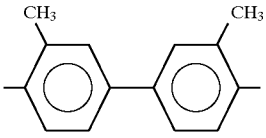

(V-b)

As a result of more detailed study, those having a structure represented by formula (V-a) have a low oxidization potential and give products having excellent charge injection property, but they tend to be somewhat poor in oxidization resistance. On the other hand, those having a structure represented by formula (V-b) have an oxidization potential approximately 0.17 V higher, and give a product excelling in oxidization resistance, but they tend to be somewhat poor in charge injection property. Consequently, copolyesters synthesized from a mixture of at least one monomer having a structure represented by formula (V-a) and at least one monomer having a structure represented by formula (V-b)

mutually supplement each disadvantage and have very good characteristics. Consequently, in the present invention, a copolyester synthesized from a mixture of at least one monomer having a structure represented by formula (V-a) and at least one monomer having a structure represented by formula (V-b) are most preferable.

The morphology of the charge transporting copolyester in the present invention may be any morphology such as a block copolymer and a random copolymer, and a random copolymer is preferable in terms of production and characteristics. The proportion of the monomers for constituting the charge transporting copolyester may be suitably set so that desired physical properties can be obtained. In order to mutually supplement each disadvantage of the monomers, the proportion is preferably from 9:1 to 1:19, and particularly equimolar.

As for the monomers which can be used as raw materials in the present invention, the structures represented by formula (I-a) are shown in Tables 1 to 5, and the structures represented by formula (I-b) are shown in Tables 6 and 10.

TABLE 1

| Structure | X | $R_1$ | $R_2$ | Bonding position | k | n |
|---|---|---|---|---|---|---|
| 1 | 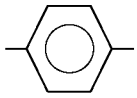 | H | H | 3 | 0 | 1 |
| 2 | 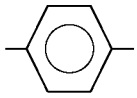 | H | H | 3 | 0 | 2 |
| 3 | 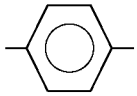 | 3-$CH_3$ | 4-$CH_3$ | 3 | 0 | 1 |
| 4 | 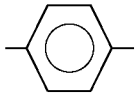 | 3-$CH_3$ | 4-$CH_3$ | 4 | 0 | 2 |
| 5 | 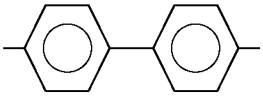 | H | H | 3 | 1 | 1 |
| 6 | 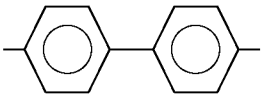 | H | H | 3 | 1 | 2 |
| 7 | 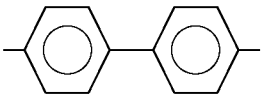 | H | H | 3 | 1 | 3 |
| 8 | 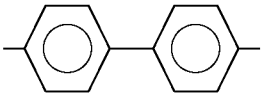 | H | 4-$CH_3$ | 3 | 1 | 2 |
| 9 | 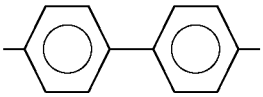 | H | 4-$C_6H_5$ | 3 | 1 | 2 |
| 10 | 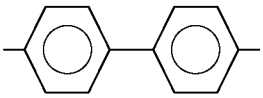 | 3-$CH_3$ | 4-$CH_3$ | 3 | 1 | 1 |
| 11 | 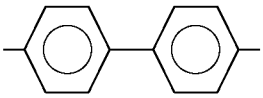 | 3-$CH_3$ | 4-$CH_3$ | 3 | 1 | 2 |
| 12 | 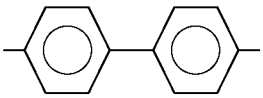 | H | H | 4 | 1 | 2 |

TABLE 1-continued
| Structure | X | $R_1$ | $R_2$ | Bonding position | k | n |
|---|---|---|---|---|---|---|
| 13 | 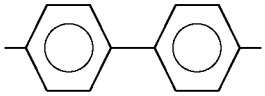 | 3-$CH_3$ | 4-$CH_3$ | 4 | 1 | 2 |
| 14 | 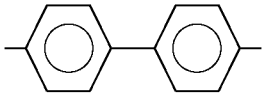 | 4-$CH_3$ | H | 4 | 1 | 2 |
| 15 | 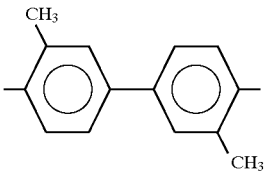 | H | H | 3 | 1 | 2 |
TABLE 2
| Structure | X | $R_1$ | $R_2$ | Bonding position | k | n |
|---|---|---|---|---|---|---|
| 16 | 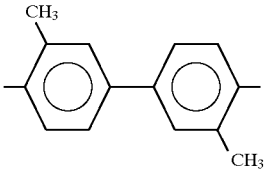 | H | H | 3 | 1 | 3 |
| 17 | 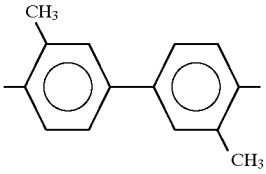 | H | 4-$CH_3$ | 3 | 1 | 2 |
| 18 | 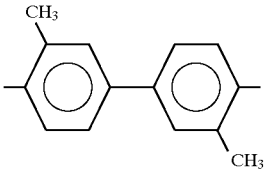 | H | 4-$C_6H_5$ | 3 | 1 | 2 |
| 19 | 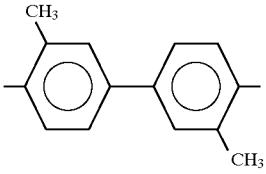 | 3-$CH_3$ | 4-$CH_3$ | 3 | 1 | 2 |
| 20 | 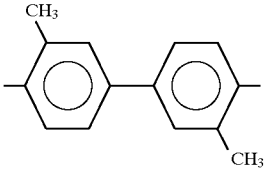 | 3-$CH_3$ | 4-$CH_3$ | 3 | 1 | 3 |

TABLE 2-continued
| Structure | X | $R_1$ | $R_2$ | Bonding position | k | n |
|---|---|---|---|---|---|---|
| 21 | 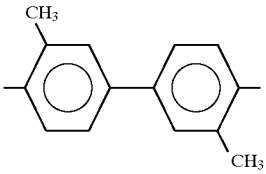 | H | H | 4 | 1 | 2 |
| 22 | 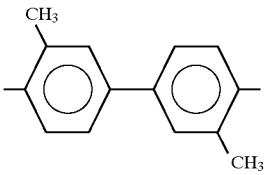 | 3-$CH_3$ | 4-$CH_3$ | 4 | 1 | 2 |
TABLE 3
| Structure | X | $R_1$ | $R_2$ | Bonding position | k | n |
|---|---|---|---|---|---|---|
| 23 | 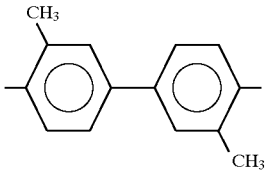 | 4-$CH_3$ | H | 4 | 1 | 2 |
| 24 | 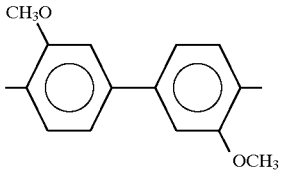 | H | H | 3 | 1 | 2 |
| 25 | 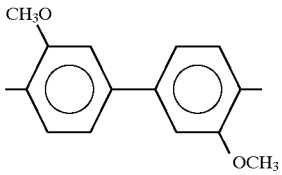 | H | H | 3 | 1 | 3 |
| 26 | 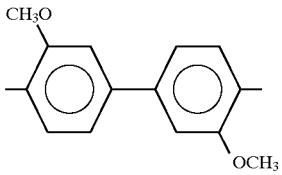 | H | 4-$CH_3$ | 3 | 1 | 2 |
| 27 | 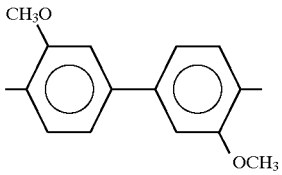 | H | 4-$C_6H_5$ | 3 | 1 | 2 |

TABLE 3-continued
| Structure | X | $R_1$ | $R_2$ | Bonding position | k | n |
|---|---|---|---|---|---|---|
| 28 | 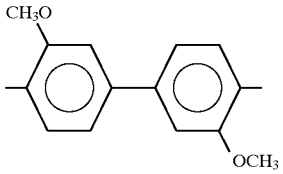 | 3-$CH_3$ | 4-$CH_3$ | 3 | 1 | 2 |
| 29 | 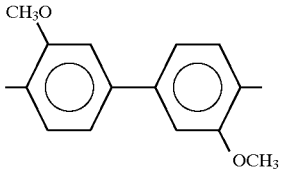 | 3-$CH_3$ | 4-$CH_3$ | 3 | 1 | 3 |
TABLE 4
| Structure | X | $R_1$ | $R_2$ | Bonding position | k | n |
|---|---|---|---|---|---|---|
| 30 | 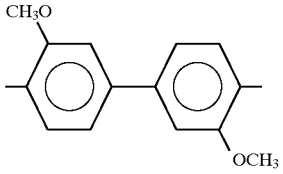 | H | H | 4 | 1 | 2 |
| 31 | 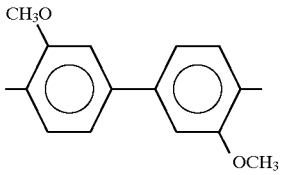 | 3-$CH_3$ | 4-$CH_3$ | 4 | 1 | 2 |
| 32 | 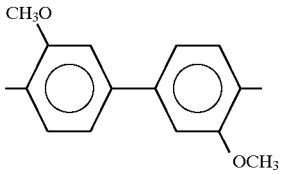 | 4-$CH_3$ | H | 4 | 1 | 2 |
| 33 | 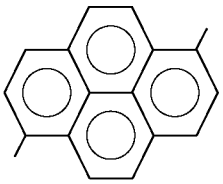 | H | H | 3 | 1 | 2 |
| 34 | 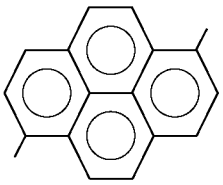 | H | 4-$CH_3$ | 3 | 1 | 2 |

TABLE 4-continued
| Structure | X | $R_1$ | $R_2$ | Bonding position | k | n |
|---|---|---|---|---|---|---|
| 35 | 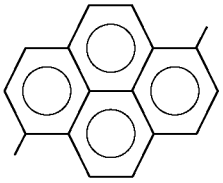 | 3-$CH_3$ | 4-$CH_3$ | 3 | 1 | 2 |
| 36 | 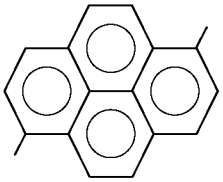 | H | H | 4 | 1 | 2 |
| 37 | 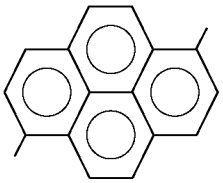 | 4-$CH_3$ | H | 4 | 1 | 2 |
TABLE 5
| Structure | X | $R_1$ | $R_2$ | Bonding position | k | n |
|---|---|---|---|---|---|---|
| 38 | 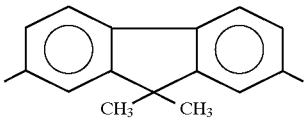 | H | H | 3 | 1 | 2 |
| 39 | 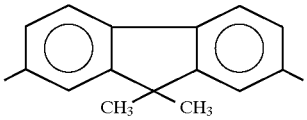 | H | 4-$CH_3$ | 3 | 1 | 2 |
| 40 | 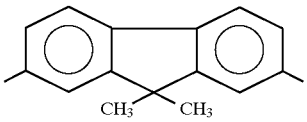 | 3-$CH_3$ | 4-$CH_3$ | 3 | 1 | 2 |
| 41 | 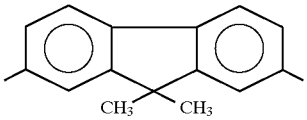 | H | H | 4 | 1 | 2 |
| 42 | 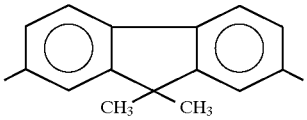 | 4-$CH_3$ | H | 4 | 1 | 2 |

TABLE 6
| Structure | X | $R_1$ | $R_2$ | Bonding position | k | n |
|---|---|---|---|---|---|---|
| 43 | 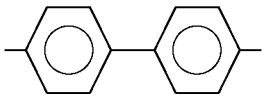 | H | H | 4,4' | 0 | 1 |
| 44 | 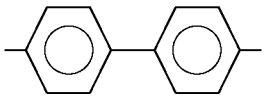 | H | H | 4,4' | 0 | 2 |
| 45 | 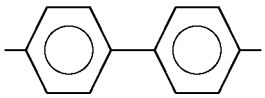 | 3-$CH_3$ | 4-$CH_3$ | 4,4' | 0 | 1 |
| 46 | 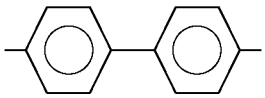 | 3-$CH_3$ | 4-$CH_3$ | 4,4' | 0 | 2 |
| 47 | 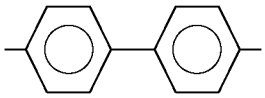 | H | H | 4,4' | 1 | 1 |
| 48 | 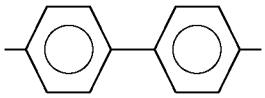 | H | H | 4,4' | 1 | 2 |
| 49 | 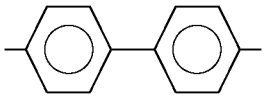 | H | H | 4,4' | 1 | 3 |
| 50 | 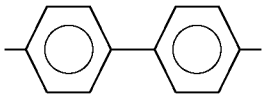 | H | 4-$CH_3$ | 4,4' | 1 | 2 |
| 51 | 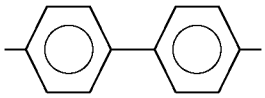 | H | 4-$C_6H_5$ | 4,4' | 1 | 2 |
| 52 | 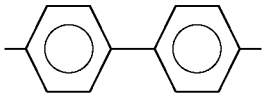 | 3-$CH_3$ | 4-$CH_3$ | 4,4' | 1 | 1 |
| 53 | 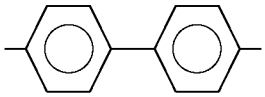 | 3-$CH_3$ | 4-$CH_3$ | 4,4' | 1 | 2 |
| 54 | 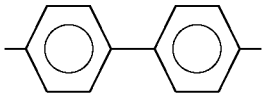 | H | H | 4,4' | 1 | 2 |
| 55 | 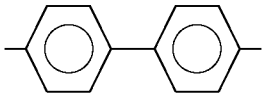 | 3-$CH_3$ | 4-$CH_3$ | 4,4' | 1 | 2 |
| 56 | 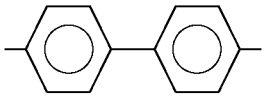 | 4-$CH_3$ | H | 4,4' | 1 | 2 |

TABLE 7
| Structure | X | $R_1$ | $R_2$ | Bonding position | k | n |
|---|---|---|---|---|---|---|
| 57 | 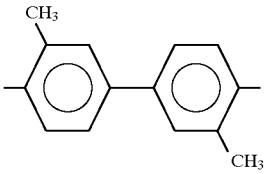 | H | H | 4,4' | 1 | 2 |
| 58 | 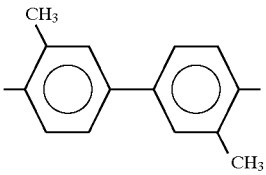 | H | H | 4,4' | 1 | 3 |
| 59 | 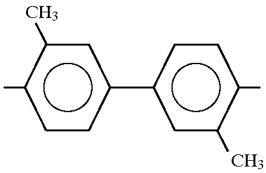 | H | 4-$CH_3$ | 4,4' | 1 | 2 |
| 60 | 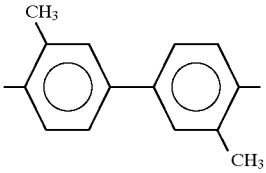 | H | 4-$C_6H_5$ | 4,4' | 1 | 2 |
| 61 | 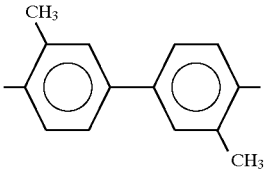 | 3-$CH_3$ | 4-$CH_3$ | 4,4' | 1 | 2 |
| 62 | 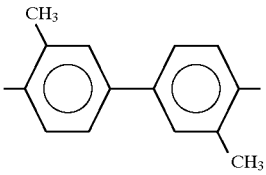 | 3-$CH_3$ | 4-$CH_3$ | 4,4' | 1 | 3 |
| 63 | 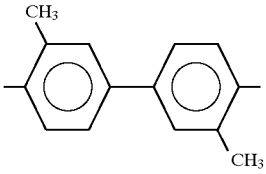 | H | H | 4,4' | 1 | 2 |

TABLE 8
| Structure | X | $R_1$ | $R_2$ | Bonding position | k | n |
|---|---|---|---|---|---|---|
| 64 | 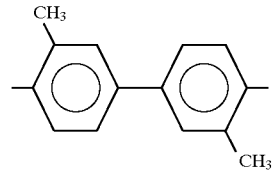 | 3-$CH_3$ | 4-$CH_3$ | 4,4' | 1 | 2 |
| 65 | 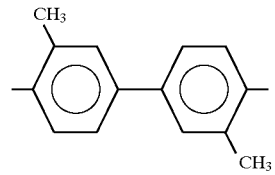 | 4-$CH_3$ | H | 4,4' | 1 | 2 |
| 66 | 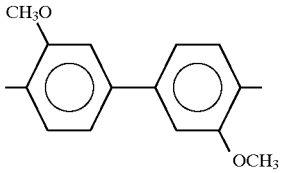 | H | H | 4,4' | 1 | 2 |
| 67 | 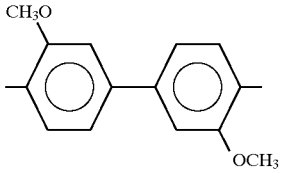 | H | H | 4,4' | 1 | 3 |
| 68 | 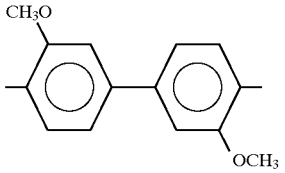 | H | 4-$CH_3$ | 4,4' | 1 | 2 |
| 69 | 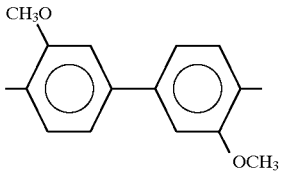 | H | 4-$C_6H_5$ | 4,4' | 1 | 2 |
| 70 | 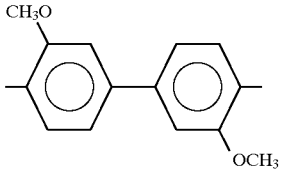 | 3-$CH_3$ | 4-$CH_3$ | 4,4' | 1 | 2 |

TABLE 9
| Structure | X | $R_1$ | $R_2$ | Bonding position | k | n |
|---|---|---|---|---|---|---|
| 71 | 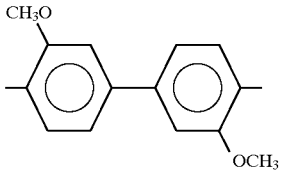 | 3-$CH_3$ | 4-$CH_3$ | 4,4' | 1 | 3 |
| 72 | 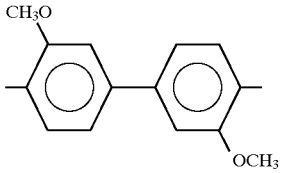 | H | H | 4,4' | 1 | 2 |
| 73 | 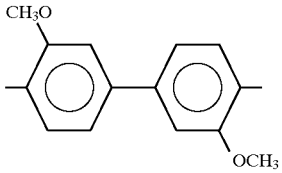 | 3-$CH_3$ | 4-$CH_3$ | 4,4' | 1 | 2 |
| 74 | 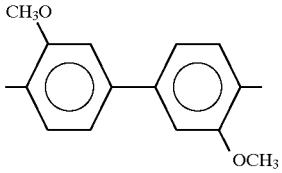 | 4-$CH_3$ | H | 4,4' | 1 | 2 |
| 75 | 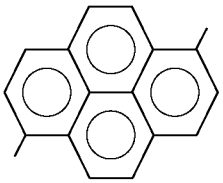 | H | H | 4,4' | 1 | 2 |
| 76 | 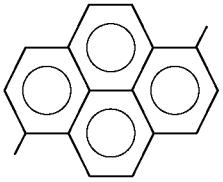 | H | 4-$CH_3$ | 4,4' | 1 | 2 |
| 77 | 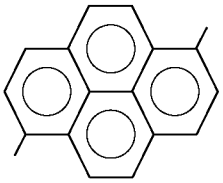 | 4-$CH_3$ | 4-$CH_3$ | 4,4' | 1 | 2 |

TABLE 10

| Structure | X | $R_1$ | $R_2$ | Bonding position | k | n |
|---|---|---|---|---|---|---|
| 78 | 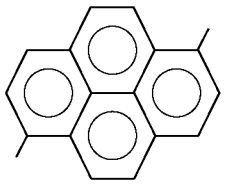 | H | H | 4,4' | 1 | 2 |
| 79 | 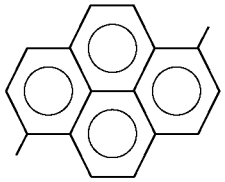 | 4-$CH_3$ | H | 4,4' | 1 | 2 |
| 80 | 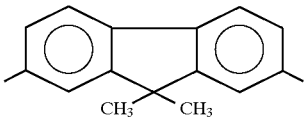 | H | H | 4,4' | 1 | 2 |
| 81 | 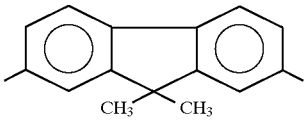 | H | 4-$CH_3$ | 4,4' | 1 | 2 |
| 82 | 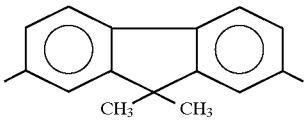 | 3-$CH_3$ | 4-$CH_3$ | 4,4' | 1 | 2 |
| 83 | 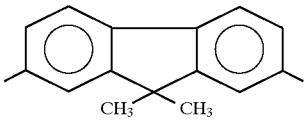 | H | H | 4,4' | 1 | 2 |
| 84 | 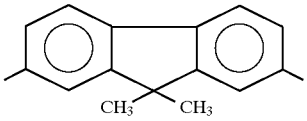 | 4-$CH_3$ | H | 4,4' | 1 | 2 |

Examples of the charge transporting copolyester synthesized using the monomers having these repeating structural units are shown in Tables 11 and 12. In the Tables, p is a polymerization degree (the number of ester units). In the Tables, the compounds in which column Z is "–" are the polymers using monomers having the structures represented by formulae (I-a) and (I-b), and the compounds where the column Z is filled in are the polymers using monomers having the structures represented by formulae (I-a), (I-b) and (II).

TABLE 11

| | Monomer | | | | | |
|---|---|---|---|---|---|---|
| Comp. | Structure | Ratio | Y | Z | m | p |
| 85 | 6/17 | 1/1 | $-CH_2CH_2-$ | — | 1 | 195 |
| 86 | 6/17 | 1/1 | $-CH_2CH_2-$ | — | 2 | 160 |
| 87 | 6/17 | 1/1 | 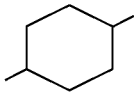 | — | 1 | 155 |

TABLE 11-continued
| Comp. | Monomer Structure | Monomer Ratio | Y | Z | m | p |
|---|---|---|---|---|---|---|
| 88 | 6/17 | 1/1 | 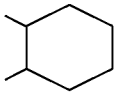 | — | 1 | 160 |
| 89 | 6/17 | 1/1 | 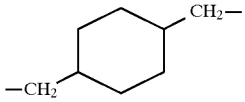 | — | 1 | 150 |
| 90 | 6/17 | 1/1 | $-CH_2CH_2-$ | 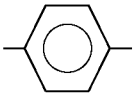 | 1 | 30 |
| 91 | 6/17 | 1/2 | $-CH_2CH_2-$ | — | 1 | 190 |
| 92 | 6/17 | 2/1 | $-CH_2CH_2-$ | — | 1 | 185 |
| 93 | 6/22 | 1/1 | $-CH_2CH_2-$ | — | 1 | 200 |
| 94 | 6/22 | 1/1 | $-CH_2CH_2-$ | — | 2 | 145 |
| 95 | 6/23 | 1/1 | $-CH_2CH_2-$ | — | 1 | 170 |
| 96 | 6/31 | 1/1 | $-CH_2CH_2-$ | — | 1 | 165 |
| 97 | 6/35 | 1/1 | $-CH_2CH_2-$ | — | 1 | 165 |
| 98 | 6/8/22 | 1/1/1 | $-CH_2CH_2-$ | — | 1 | 195 |
| 99 | 6/48 | 1/1 | $-CH_2CH_2-$ | — | 1 | 170 |
| 100 | 6/53 | 1/1 | $-CH_2CH_2-$ | — | 1 | 170 |
| 101 | 6/61 | 1/1 | $-CH_2CH_2-$ | 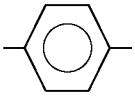 | 1 | 35 |
| 102 | 6/61 | 1/1 | $-CH_2CH_2-$ | — | 1 | 185 |
| 103 | 6/70 | 1/1 | $-CH_2CH_2-$ | — | 1 | 180 |
TABLE 12
| Comp. | Monomer Structure | Monomer Ratio | Y | Z | m | p |
|---|---|---|---|---|---|---|
| 104 | 6/77 | 1/1 | $-CH_2CH_2-$ | — | 1 | 160 |
| 105 | 6/82 | 1/1 | $-CH_2CH_2-$ | — | 1 | 165 |
| 106 | 8/19 | 1/1 | $-CH_2CH_2-$ | — | 1 | 160 |
| 107 | 8/22 | 1/1 | $-CH_2CH_2-$ | — | 1 | 205 |
| 108 | 8/22 | 1/1 | $-CH_2CH_2-$ | — | 2 | 155 |
| 109 | 8/22 | 1/1 | 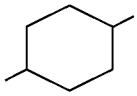 | — | 1 | 160 |
| 110 | 8/22 | 1/1 | 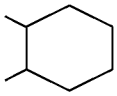 | — | 1 | 155 |
| 111 | 8/22 | 1/1 | 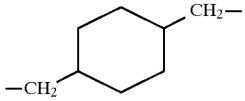 | — | 1 | 140 |
| 112 | 8/22 | 1/1 | $-CH_2CH_2-$ | 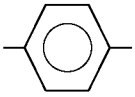 | 1 | 35 |
| 113 | 8/22 | 1/2 | $-CH_2CH_2-$ | — | 1 | 200 |

TABLE 12-continued

| Comp. | Monomer Structure | Monomer Ratio | Y | Z | m | p |
|---|---|---|---|---|---|---|
| 114 | 8/22 | 2/1 | $-CH_2CH_2-$ | — | 1 | 200 |
| 115 | 48/61 | 1/1 | $-CH_2CH_2-$ | — | 1 | 180 |
| 116 | 48/63 | 1/1 | $-CH_2CH_2-$ | — | 1 | 185 |
| 117 | 6/8 | 1/1 | $-CH_2CH_2-$ | — | 1 | 190 |
| 118 | 17/19 | 1/1 | $-CH_2CH_2-$ | — | 1 | 195 |
| 119 | 48/53 | 1/1 | $-CH_2CH_2-$ | — | 2 | 160 |
| 120 | 59/61 | 1/1 | $-CH_2CH_2-$ | — | 1 | 190 |

Conventionally, with regard to the synthesis of a charge transporting material having an alkylenecarboxylic ester group, JP-A-5-80550 discloses a process of introducing a chloromethyl group, forming a Grignard reagent with Mg, and converting it into a carboxylic acid with carbon dioxide, followed by esterification. However, in this process, chloromethyl group which has high reactivity cannot be introduced at the initial stage of the raw material. Consequently, it is required that after a skeleton of such as triarylamine or tetraarylbenzidine is formed, for example, the methyl group which has been introduced at the initial stage of the raw material is chloromethylated, that an unsubstituted raw material is used at the raw material stage and, after the formation of a tetraarylbenzidine skeleton, a functional group such as formyl group is introduced by substitution reaction to the aromatic ring, followed by the reduction to an alcohol, which is derived to a chloromethyl group using a halogenating agent such as thionyl chloride, or that direct chloromethylation is carried out using paraformaldehyde and hydrochloric acid. However, a charge transporting material having a skeleton of such as triarylamine or tetraarylbenzidine has a very high reactivity. In the process of chloromethylation of the introduced methyl group, since a substitution/reaction of the halogen atom to the aromatic ring easily takes place, it is substantially impossible to selectively chlorinate only the methyl group. In the process where an substituted raw material is used at the raw material stage and after a functional group such as formyl group is introduced, followed by deriving to chloromethyl group and the process of the direct chloromethylation, the chloromethyl group can be introduced only into the para position relative to the nitrogen atom and, thus, the alkylenecarboxylic acid ester group can also be introduced only into the para position relative to the nitrogen atom. On the other hand, a process in which an arylamine or diarylbenzidine is reacted with a halogenated carboalkoxyalkylbenzene to obtain a monomer has an advantage that the position of the substituent can be easily changed to control the ionization potential, and makes it possible to control the ionization potential of charge transporting polymers. The charge transporting monomer for use in the present invention can be easily introduced various substituents in a desired position, and is easy to be handled because it is chemically stable. Thus, the above problems has been solved.

The novel charge transporting copolyester of the present invention can be synthesized by polymerizing at least two dibasic carboxylic acid derivatives selected from the charge transporting monomers represented by formulae (VI) and (VII) with a dibasic alcohol represented by HO—(Y—O)$_m$—H, according to a known process, for example, as described in "Daiyonpan Jikken Kagaku Koza (Experimental Chemistry Lecture, the 4th Edition)", Vol. 28:

(VI)

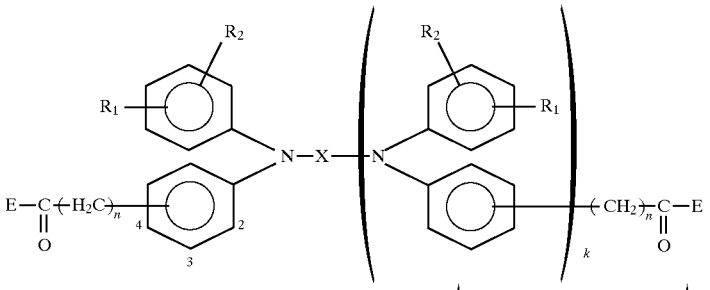

(VII)

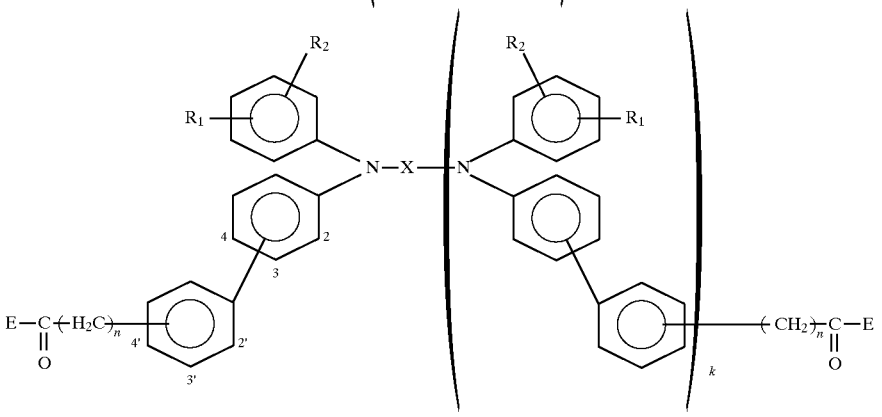

wherein $R_1$ and $R_2$ are independently a hydrogen atom, an alkyl group, an alkoxy group, a substituted amino group, a halogen atom, or a substituted or unsubstituted aryl group; X is a substituted or unsubstituted divalent aromatic residue; n is an integer of from 1 to 5; k is an integer of 0 or 1; and E is a hydroxyl group, a halogen atom, or —O—$R_{13}$, where $R_{13}$ is an alkyl group or a substituted or unsubstituted aryl group.

To be specific, when E is a hydroxyl group, the dihydric alcohol represented by HO—(Y—O)$_m$—H is mixed in an approximately equimolar amount relative to the total of two or more charge transporting monomers, and is polymerized using an acid catalyst. Examples of the acid catalyst which can be used are those which can be used in a usual esterification such as sulfuric acid, toluenesulfonic acid, and trifluoroacetic acid, and the acid catalyst is used in an amount of from 1/10,000 to 1/10 part by weight, and preferably from 1/1,000 to 1/50 part by weight, based on part by weight of the charge transporting monomer. In order to remove the water formed during the polymerization, a solvent which is azeotropic with water is preferably used, and toluene, chlorobenzene, 1-chloronaphthalene, etc. are effective. The solvent is used in an amount of from 1 to 100 parts by weight, and preferably from 2 to 50 parts by weight, based on part by weight of the charge transporting monomer.

The reaction temperature can be suitably selected, but the reaction is preferably carried out at the boiling point of the solvent in order to remove the water formed during the polymerization.

After the reaction, when using no solvent, the reaction product is dissolved in a solvent which can dissolve the product. When using a solvent, the reaction solution is added dropwise to a poor solvent which is difficult to dissolve the polymer such as an alcohol including methanol and ethanol or acetone as is, to precipitate the charge transporting copolyester, and after the charge transporting copolyester is separated, it is thoroughly washed with water or an organic solvent, and then dried. Moreover, if necessary, the charge transporting copolyester may be dissolved in an appropriate organic solvent, a reprecipitation treatment, i.e., a treatment comprising adding dropwise to a poor solvent, and precipitating the charge transporting copolyester, may be repeatedly carried out. In the reprecipitation treatment, it is preferable to carry out such a treatment with effectively stirring by a mechanical stirrer, etc. The solvent which dissolve the charge transporting copolyester in the reprecipitation is used in an amount of from 1 to 100 parts by weight, and preferably from 2 to 50 parts by weight, based on part by weight of the charge transporting copolyester. The poor solvent is used in an amount of from 1 to 1,000 parts by weight, and preferably from 10 to 500 parts by weight, based on part by weight of the charge transporting copolyester.

When E is a halogen atom, the dihydric alcohol represented by HO—(Y—O)$_m$—H is mixed in an approximately equimolar amount, and the polymerization is carried out using an organic basic catalyst such as pyridine or triethylamine. The organic basic catalyst is used in an amount of from 1 to 10 equivalents, and preferably from 2 to 5 equivalents, based on the charge transporting monomer. Effective solvents are methyleno-chloride, tetrahydrofuran (THF), toluene, chlorobenzene, and 1-chloronaphthalene and they are used in an amount of from 1 to 100 parts by weight, and preferably from 2 to 50 parts by weight, based on part by weight of the charge transporting monomer. The reaction temperature can be freely selected. After the polymerization, the reaction product is purified by the reprecipitation treatment as described above.

When a dihydric alcohol having a high acidity such as bisphenol is used, interfacial polymerization can also be used. To be specific, a dihydric alcohol is added to water, an equivalent amount of base is added to dissolve the alcohol, after which the dihydric alcohol and an equivalent amount of the charge transporting monomer are added with vigorously stirring, whereby the polymerization can be carried out. In this case, water is used in an amount of from 1 to 1,000 parts by weight, and preferably from 2 to 500 parts by weight, based on part by weight of the dihydric alcohol. The solvents effective for dissolving the charge transporting monomer are methylene chloride, dichloroethane, trichloroethane, toluene, chlorobenzene and 1-chloronaphthalene. The reaction temperature can be suitably selected, and it is effective to use a phase transition catalyst such as an ammonium salt or a sulfonium salt so as to accelerate the reaction. The phase transition catalyst is used in an amount of from 0.1 to 10 parts by weight, and preferably from 0.2 to 5 parts by weight, based on part by weight of the charge transporting monomer.

When E is —O—$R_{13}$, the dihydric alcohol represented by HO—(Y—O)$_m$—H is added in an excessive amount relative to the total of the charge transporting monomers, and the system is heated with a catalyst such as an inorganic acid inclusive of sulfuric acid and phosphoric acid, a titanium alkoxide, an acetate or carbonate of calcium or cobalt, or an oxide of zinc or lead, and the polymer can be synthesized by a transesterification. The dihydric alcohol is used in an amount of from 2 to 100 equivalents, and preferably from 3 to 50 equivalents, based on the charge transporting monomer. The catalyst is used in an amount of from 1/10,000 to 1 part by weight, and preferably from 1/1,000 to ½ part by weight, based on part by weight of the charge transporting monomer. The reaction is carried out at a reaction temperature of from 200° to 300° C., and it is preferable to carry out the reaction at a reduced pressure in order to accelerate the polymerization by liberating HO—(Y—O)$_m$—H after the transesterification from the group, —O—$R_{13}$ to —O—(Y—O)$_m$—H. It is also possible to use a high boiling point solvent which is azeotropic with HO—(Y—O)$_m$—H such as 1-chloronaphthalene to cause the reaction under normal pressure while azeotropically removing HO—(Y—O)$_m$—H.

Moreover, in each case, the dihydric alcohol is added in an excess amount to carry out the reaction, the formed compounds represented by the following formulae (VIII-a) and (VIII-b) are converted into charge transporting monomers, after which they can be reacted with the dibasic carboxylic acid or dibasic carboxylic acid halide to obtain the charge transporting copolyester as in the same manner.

(VIII-a)

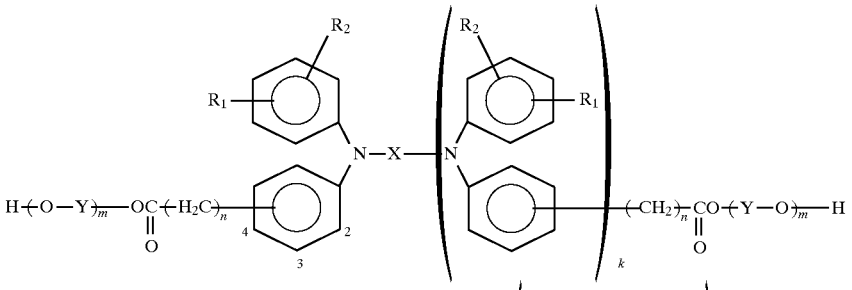

(VIII-b)

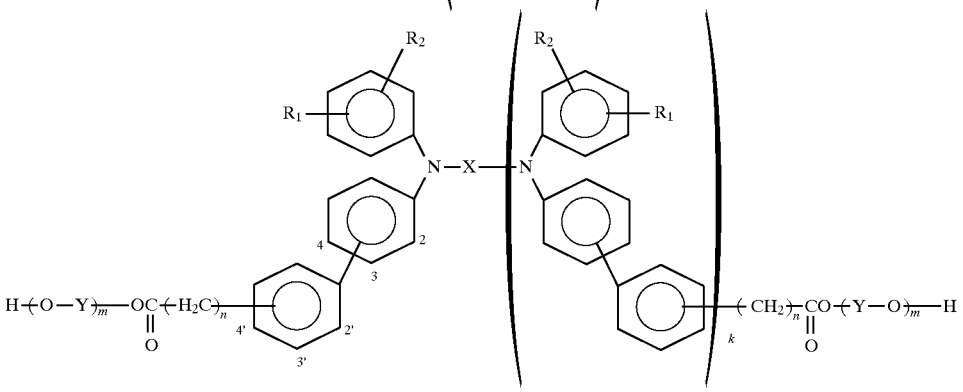

If the polymerization degree, p, of the novel charge transporting copolyester is too low, there is lacking in the film forming ability and it is difficult to obtain a strong film, and conversely, if it is too high, the processability is deteriorated. Consequently, the polymerization degree is set at a range from 5 to 5,000, preferably from 10 to 3,000, and more preferably from 15 to 1,000. The terminals of the polymer may be modified, if desired.

The novel charge transporting copolyester of the present invention may be used in combination with any conventionally suggested charge generating materials such as bisazo pigments, phthalocyanine pigments, squaralium pigments, perylene pigments, and dibromoanthoanthrone, and particularly used together with halogenated gallium phthalocyanine crystals as already disclosed in JP-A-5-98181, halogenated tin phthalocyanine crystals as disclosed in JP-A-5-140472 and JP-A-5-140473, hydroxygallium phthalocyanine crystals as disclosed in JP-A-5-263007 and JPA-5-279591, titanyl phthalocyanine hydrate crystals as disclosed in JP-A-4-189873 and JP-A-5-43813. This makes it possible to obtain an electrophotographic photoreceptor excelling in sensitivity and stability in repeated use. Furthermore, the charge transporting copolyester can be applied to organic electroluminescence devices.

The chlorogallium phthalocyanine crystals which are used in the present invention can be produced, as described in JP-A-5-98181, by mechanically dry-pulverizing a chlorogallium phthalocyanine crystal produced by the known process by means of an automatic mortar, a planetary ball mill, a vibration mill, a CF mill, a roll mill, a sand mill, or a kneader, or by wet-pulverizing the chlorogallium phthalocyanine crystal having been dry-pulverized together with a solvent using a ball mill, a mortar, a sand mill, or a kneader. Examples of the solvents which are used in the above-mentioned treatment are aromatics (e.g., toluene and chlorobenzene), amides (e.g., dimethylformamide and N-methylpyrrolidone), aliphatic alcohols (e.g., methanol, ethanol, and butanol), aliphatic polyhydric alcohols (e,g., ethylene glycol, glycerine and polyethylene glycol), aromatic alcohols (e.g., benzyl alcohol and phenethyl alcohol), esters (e.g., acetate and butyl acetate), ketones (e.g., acetone and methyl ethyl ketone), dimethylsulfoxide, ethers (e.g., diethyl ether and tetrahydrofuran), and mixed solvent systems comprising several solvents, and mixed solvent systems of these organic solvents with water. The solvent used is utilized in an amount of from 1 to 200 times, and preferably from 10 to 100 times, the weight of chlorogallium phthalocyanine used. The treatment is carried out at a temperature of from 0° C. up to the boiling point of the solvent, and preferably from 10° to 60° C. In the pulverization, an attrition aid such as table salt and mirabilite may be used. The attrition aid may be used in an amount of from 0.5 to 20 times, and preferably from 1 to 10 times, the weight of chlorogallium phthalocyanine.

Dichlorotin phthalocyanine crystals can be obtained as described in JP-A-5-140472 and JP-A-5-140473, by pulverizing a dichlorotin phthalocyanine crystal produced by the known process as in the case of the chlorogallium phthalocyanine, followed by a treatment with solvent.

Hydroxygallium phthalocyanine crystals can be obtained, as described in JP-A-5-263007 and JP-A-5-279591, by subjecting a chlorogallium phthalocyanine crystal produced by the known process to hydrolysis in an acidic or an alkaline aqueous solution or to acid pasting to synthesize a hydroxygallium phthalocyanine crystal, and then directly solvent-treating the crystal, or by wet-pulverizing the hydroxygallium phthalocyanine crystal obtained by the synthesis together with a solvent by means of a ball mill, a mortar, a sand mill, or a kneader, or by dry-pulverizing the crystal without solvent, and then treating the crystal with a solvent.

Examples of the solvents which are used in the above-mentioned treatment are aromatics (e.g., toluene and chlorobenzene), amides (e.g., dimethylformamide and N-methylpyrrolidone), aliphatic alcohols (e.g., methanol, ethanol, and butanol), aliphatic polyhydric alcohols (e,g., ethylene glycol, glycerine and polyethylene glycol), aromatic alcohols (e.g., benzyl alcohol and phenethyl alcohol), esters (e.g., acetate and butyl acetate), ketones (e.g., acetone and methyl ethyl ketone), dimethylsulfoxide, ethers (e.g., diethyl ether and tetrahydrofran), and mixed solvent systems comprising several solvents, and mixed solvent systems of these organic solvents with water. The solvent used is utilized in an amount of from 1 to 200 times, and preferably from 10 to 100 times, the weight of hydroxygallium phthalocyanine. The treatment is carried out at a temperature of from 0° to 150° C., and preferably from room temperature to 100° C. In the pulverization, an attrition aid such as table salt and mirabilite may be used. The attrition aid may be used in an amount of from 0.5 to 20 times, and preferably from 1 to 10 times, the weight of hydroxygallium phthalocyanine.

Titanyl phthalocyanine crystals can be produced as disclosed in JP-A-4-189873 and JP-A-5-43813, by acid-pasting or salt-milling a titanyl phthalocyanine crystal produced by a known process together with an inorganic salt using a ball mill, a mortar, a sand mill or a kneader to provide a titanyl phthalocyanine crystal having a relatively low crystallinity and having a peak at $2\theta \pm 0.2° = 27.2°$ in an X ray diffractive spectrum and then directly treating the crystal with a solvent, or wet-pulverizing the crystal with a solvent by a ball mill, a mortar, a sand mill or kneader. As the acid used in the acid-pasting, sulfuric acid is preferable, and sulfuric acid having a concentration of from 70 to 100%, and preferably from 95 to 100% is used. The dissolving temperature is set at a range of from −20° to 100° C., and preferably from 0° to 60° C. The amount of sulfuric acid is set at a range of from 1 to 100 times, and preferably 3 to 50 times, the weight of the titanyl phthalocyanine crystal. The solvent which is used for precipitation is preferably water or a mixed solvent of water with an organic solvent utilized in a voluntary amount. Particular preference is given to the use of a mixed solvent comprising water and an alcoholic solvent such as methanol and ethanol, or comprising water and an aromatic solvent such as benzene and toluene. Although the temperature for the precipitation is not specifically restricted, it is preferable to cool the system with an ice, etc., for preventing an exotherm. The proportion of the titanyl phthalocyanine to the inorganic salt on the weight basis is from 1/0.1 to 1/20, and preferably from 1/0.5 to ⅕. Examples of the solvents which are used in the above-mentioned treatment are aromatics (e.g., toluene and chlorobenzene), aliphatic alcohols (e.g., methanol, ethanol, and butanol), halogenated hydrocarbons (e.g., dichloromethane, chloroform and trichloroethane), and mixed solvent systems comprising several solvents, and mixed solvent systems of these organic solvents with water. The solvent used is utilized in an amount of from 1 to 100 times, and preferably from 5 to 50 times, the weight of titanyl phthalocyanine. The treating temperature is set at from room temperature to 100° C., and preferably from 50° to 100° C. An attrition aid may be used in an amount of from 0.5 to 20 times, and preferably from 1 to 10 times, the weight of titanyl phthalocyanine.

FIGS. 1 (*a*) to (*f*) are schematically cross-sectional views of the electrophotographic photoreceptors of the present invention. In FIG. (*a*), electric charge generating layer 1 is provided on electroconductive substrate 3, and charge transporting layer 2 is provided thereon. In FIG. 1 (*b*), undercoat layer 4 is provided on electroconductive substrate 3, and in FIG. 1 (*c*), protective layer (overcoat layer) 5 is provided on the surface. Furthermore, in FIG. 1 (*d*), both undercoat layer 4 and protective layer 5 are provided. The materials shown in FIGS. 1 (*e*) and (*f*) have a single layer structure having photosensitive layer 6, and in FIG. 1 (*f*), undercoat layer 4 is provided. The novel charge transporting copolyester of the present invention may be used in any constitution shown in FIGS. 1 (*a*) to (*f*).

For Example, in FIG. 1 (*c*), the charge transporting copolyester for use in the present invention (i) may be contained in charge transporting layer 2 while a known protective layer is provided thereon as protective layer 5, or (ii) may be contained in protective layer 5 while a known charge transporting layer is provided as charge transporting layer 2. An advantage of (i) above is as follows. A conventional charge transporting layer may be suffered from a solvent for use in the formation of a protective layer; however, the charge transporting layer containing the charge transporting copolyester for use in the present invention is hardly suffered from the solvent so that a clean protective layer can be obtained. In the case of (ii) above, the protective layer containing the charge transporting copolyester for use in the present invention has an excellent effect as a protective layer for a conventional charge transporting layer. Thus, the charge transporting copolyester for use in the present invention may be contained in a photosensitive layer of a single layer structure, in a charge transporting layer of a laminate layer structure, or in a protective layer.

Examples of the electroconductive substrates include metals such as aluminum, nickel, chromium, and stainless steel, plastic films having a thin film such as made of aluminum, titanium, nickel, chromium, stainless steel, gold, vanadium, tin oxide, indium oxide and ITO, and paper or plastic films in which an electroconductivity-imparting agent is coated or impregnated. These electroconductive substrates may be used in an appropriate form such as in the form of drum, sheet, or plate, but the substrate is not restricted thereto. Optionally, the surface of the electroconductive substrate may be treated in various manners within the range where image quality is not influenced. For example, a surface-oxidizing treatment, a surface-chemical treatment, a coloring treatment, and an irregular reflection treatment such as surface-grinding treatment can be carried out. An undercoat layer may be further provided between the electroconductive substrate and the charge generating layer. This undercoat layer has a function of inhibiting the charge injection from the electroconductive substrate to the photosensitive layer during charging, a function of integrally adhering and maintaining the photosensitive layer and the electroconductive substrate, or in some cases, a function of preventing the light reflection of the electroconductive substrate.

The binder resins which can be used in this undercoat layer include known materials such as polyethylene resins, polypropylene resins, acrylic resins, methacrylic resins, polyamide resins, vinyl chloride resins, vinyl acetate resins, phenol resins, polycarbonate resins, polyurethane resins, polyimide resins, vinylidene chloride resin, polyvinyl acetal resins, vinyl chloride-vinyl acetate copolymers, polyvinyl alcohol resins, water-soluble polyester resins, nitrocellulose, casein, gelatine, polyglutamic acid, starch, starch acetates, amino starch, polyacrylic acids, polyacrylamides, zirconium chelate compounds, titanyl chelate compounds, organic titanyl compounds, and silane coupling agents. An appropriate thickness of the undercoat layer is from 0.01 to 10 $\mu$m, and preferably from 0.05 to 2 $\mu$m. As the process for coating the undercoat layer is used, a usual process such as a blade coating, a Mayer bar coating, a spray coating, an impregnation coating, a bead coating, an air-knife coating, or a curtain coating can be used.

The charge transporting layer may be composed of the charge transporting copolyester of the present invention alone or in combination with the known binder resin, any other hydrazone charge transporting material, triarylamine charge transporting material, and stilbene charge transporting material. Examples of the binder resins which can be used include, but are not restricted to, known resins such as polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicon resins, silicon-alkyd resins, poly-N-vinylcarbazole, and polysilane. Of these binder resins, polycarbonate resins comprising repeating structural units represented by the following formulae (IX) to (XIV) or polycarbonate resins copolymerized thereof have good compatibility and give a uniform film, and show particularly good characteristics. The compounding proportion of the charge transporting copolyester to the binder resin based on weight is preferably from 10:0 to 8:10. When any other charge transporting material is mixed, the proportion of the charge transporting copolyester plus the binder resin to the charge transporting material is preferably from 10:0 to 10:8.

(IX)

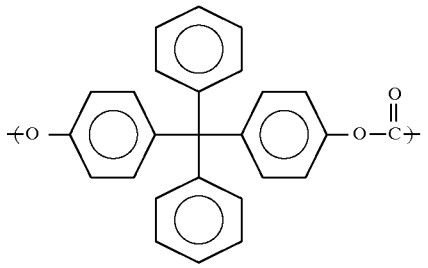

(X)

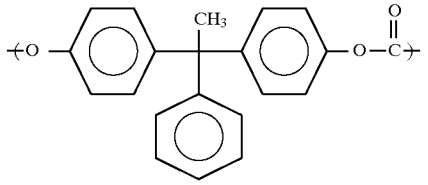

(XI)

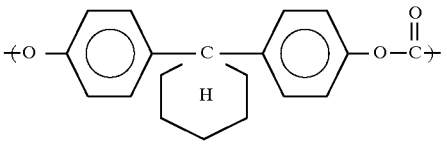

(XII)

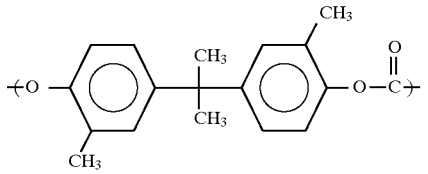

(XIII)

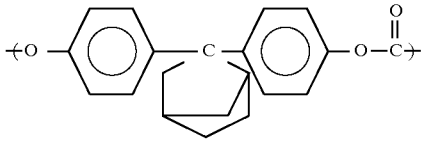

(XIV)

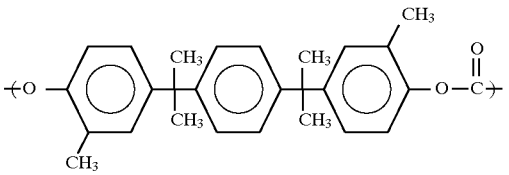

The charge generating layer is formed by optionally incorporating a charge generating material into a binder resin. Examples of the charge generating materials which can be used are any known materials such as bisazo pigments, phthalocyanine pigments, squaralium pigments, perylene pigments, and dibromoanthoanthrone, and the halogenated gallium phthalocyanine crystals, halogenated tin phthalocyanine crystals, hydroxygallium phthalocyanine crystals, titanyl phthalocyanine hydrate crystals described previously are preferably used.

The binder resin which is used in the charge generating layer can be selected from wide range of insulating resins. It is also selected from organic photoconductive copolyesters such as poly (N-vinylcarbazole), polyvinylanthracene, polyvinylpyrene, and polysilane. Examples of preferable binder resins which can be mentioned include, but are not restricted to, insulating resins such as poly (vinyl butyral) resins, polyallylate resins (e.g., polycondensation products between bisphenol A and phthalic acid), polycarbonate resins, polyester resins, phenoxy resins, vinyl chloride-vinyl acetate copolymers, polyamide resins, acrylic resins, polyacrylamide resins, poly (vinyl pyridine) resins, cellulose resins, urethane resins, epoxy resins, casein, poly (vinyl alcohol) resins, polyvinylpyrrolidone. These binder resins can be used singly or as a mixture of two or more thereof.

The compounding proportion of the charge generating material to the binder resin (weight basis) is preferably from 10:1 to 1:10. As a process for dispersing them, a generally employed process such as a ball mill dispersing process, an attritor dispersing process, or a sand mill dispersing process can be used.

In the dispersing, it is effective to set the particle size of the charge generating material at not more than 0.5 $\mu$m, preferably not more than 0.3 $\mu$m, and more preferably not more than 0.15 $\mu$m. The solvents used in this case include organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene, and that can be used singly or as a mixture of two or more thereof.

The protective layer for use in the present invention may be composed of any known material, or of the charge transporting copolymer of the present invention alone or in combination with known binder resin exemplified above in the charge transporting layer. When the charge transporting polymer of the present invention is used for a protective layer, the compounding proportion of the charge transporting copolymer to the binder resin based on weight is preferably from 10:0 to 8:10.

The following examples are provided to further illustrate the present invention. It is understood, however, that the examples are for purpose of illustration only and are not to be construed to limit the scope of the invention.

Synthetic Example 1

Synthesis of N,N'-diphenyl-N,N'-bis[3-(2-ethoxycarbonylethyl)phenyl]-[1,1'-biphenyl]-4,4'-diamine (Monomer having Structure 6)

Into a 100 ml flask were placed 10.77 g of N,N'-diphenylbenzidine, 23.0 g of ethyl 3-iododihydrocinnamate, 11.61 g of potassium carbonate, 1.0 g of copper sulfate pentahydrate, and 20 ml of n-tridecane, and they were thermally reacted under an atmosphere of $N_2$ at 230° C. for 1 hour. After the reaction, the reaction mixture was cooled down to room temperature, dissolved in 50 ml of toluene, the insolubles were filtered, and the filtrate was purified by silica gel chromatography using toluene. This gave 19.6 g of N,N'-diphenyl-N,N'-bis[3-(2-ethoxycarbonylethyl)phenyl]-[1,1'-biphenyl]-4,4'-diamine in an oily state.

Synthetic Example 2

Synthesis of 3,3'-dimethyl-N,N'-bis(3,4-dimethylphenyl)-N,N'bis-[4-(2-methoxycarbonylethyl)phenyl]-[1,1'-biphenyl]-4,4'-diamine (Monomer having Structure 22)

Into a 500 ml flask were placed 45 g of N-3,4-dimethylphenyl)-N-[4-(2-methoxycarbonylethyl)-phenyl] amine, 30.0 g of 4,4'-diiodo-3,3'-dimethylbiphenyl, 27 g of potassium carbonate, 5 g of copper sulfate pentahydrate, and 50 ml of n-tridecane, and they were thermally reacted under an atmosphere of $N_2$ at 230° C. for 5 hours. After the reaction, the reaction mixture was cooled down to room temperature, dissolved in 200 ml of toluene, the insolubles were filtered, and the filtrate was purified by silica gel chromatography using toluene, and recrystallized from a mixed solvent comprising ethyl acetate and ethanol. This gave 38 g of 3,3'-dimethyl-N,N'-bis(3,4-dimethylphenyl)-N,N'-bis-[4-(2-methoxycarbonylethyl)phenyl]-[1,1'-biphenyl]-4,4'-diamine as a light-yellow powder.

Synthetic Example 3

Synthesis of N,N'-diphenyl-N,N'-bis[4-(4-ethoxycarbonylethylphenyl)phenyl]-[1,1-biphenyl]-4,4'-diamine (Monomer having Structure 48)

Into a 100 ml flask were placed 5.0 g of N,N'-diphenylbenzidine, 12.0 g of 4-ethoxycarbinylethyl-4'-iodobiphenyl, 5.3 g of potassium carbonate, 1.0 g of copper sulfate pentahydrate, and 20 ml of n-tridecane, and they were thermally reacted under an atmosphere of $N_2$ at 230° C. for 1 hour. After the reaction, the reaction mixture was cooled down to room temperature, dissolved in 50 mg of toluene, the insolubles were filtered, and the filtrate was purified by silica gel chromatography using toluene. This gave 8.2 g of N,N'-diphenyl-N,N'-bis[4-(4-ethoxycarbonylethylphenyl)phenyl]-[1,1'-biphenyl]-4,4'-diamine in an oily state.

Synthetic Example 4

Synthesis of N,N'-diphenyl-N,N'-bis[4-(4-ethoxycarbonylmethylphenyl)phenyl]-[1,1'-biphenyl]-4,4'-diamine (Monomer having Structure 47)

Into a 100 ml flask were placed 3.0 g of N,N'-diphenylbenzidine, 7.0 g of 4-ethoxycarbinylmethyl-4'-iodobiphenyl, 3.2 g of potassium carbonate, 0.5 g of copper sulfate pentahydrate, and 10 ml of n-tridecane, and they were thermally reacted under an atmosphere of $N_2$ at 230° C. for 1 hour. After the reaction, the reaction mixture was cooled down to room temperature, dissolved in 20 ml of toluene, the insolubles were filtered, and the filtrate was purified by silica gel chromatography using toluene. This gave 5.6 g of N,N'-diphenyl-N,N'-bis[4-(4-ethoxycarbonylmethylphenyl)phenyl]-[1,1'-biphenyl]-4,4'-diamine in an oily state.

Synthetic Example 5

Synthesis of Charge Transporting Copolyester (90)

Into 500 ml flask were placed 5 g of the monomer having Structure 6 synthesized in Synthetic Example 1, 5.2 g of the monomer having structure 17, 20 g of ethylene glycol, 0.1 g of tetrabutoxy titanium, and heated and refluxed under an atmosphere of $N_2$ for 3 hours. Thereafter, the ethylene glycol was distilled off by reducing the pressure to 0.5 mmHg, and the system was cooled to room temperature. After being dissolved in 200 ml of methylene chloride, a solution of 2.9 g of phthalic dichloride dissolved in 100 ml of methylene chloride was added dropwise. Furthermore, 5.0 g of triethylamine was added, and the system was heated and refluxed for 30 minutes. Then, 3 ml of methanol was added, the system was further heated and refluxed for 30 minutes, and the insoluble was filtered, the filtrate was added dropwise to 1000 ml of ethanol with stirring to precipitate a polymer. The system was filtered, the resulting polymer was again dissolved in 500 ml of THF, and added dropwise to 1500 ml of water with stirring to precipitate the polymer. The resulting polymer was filtered, thoroughly washed with ethanol, and dried to obtain 9.1 g of the polymer. The molecular weight determination by GPC showed that $M_w=2.64\times10^4$ (styrene standard, p is approximately 30).

Synthetic Example 6

Synthesis of Charge Transporting Copolyester (93)

Into 50 ml flask were placed 5.0 g of the monomer having Structure 6 synthesized in Synthetic Example 1, 5.4 g of the monomer having Structure 22 synthesized in Synthetic Example 2, 20 g of ethylene glycol, 0.1 g of tetrabutoxy titanium, and heated and refluxed under an atmosphere of $N_2$ for 2 hours. Thereafter, while the ethylene glycol was distilled off by reducing the pressure to 0.5 mmHg, the system was heated to 230° C., and the reaction was continued for another 5 hours. Thereafter, the system was cooled down to room temperature, and dissolved in 250 ml of methylene chloride, the insolubles were filtered, the filtrate was added dropwise to 1500 ml of ethanol with stirring to precipitate a polymer. The resulting polymer was filtered, thoroughly washed with ethanol, and then dried to obtain 10.1 g of the polymer. The molecular weight determination by GPC showed that $M_W=1.40\times10^5$ (styrene standard, p is approximately 200).

Similarly, other charge transporting copolyesters shown in Tables 11 and 12 were synthesized.

Synthetic Example 7

To 230 parts of quinoline were added 30 parts of 1,3-diiminoisoindoline and 9.1 parts of gallium trichloride, and they were reacted at 200° C. for 3 hours, after which the product was filtered off, washed with acetone and with methanol. After the wet cake was dried, 28 parts of chlorogallium phthalocyanine crystal was obtained. Using an automatic mortar (Lab-Mill, Type UT-21, produced by Yamato Kagaku K.K.), 3 parts of the resulting chlorogallium phthalocyanine crystal was dry-pulverized for 3 hours, and 0.5 part of the crystal was milled together with 60 parts of glass bead (1 mm in diameter) at room temperature in 20 parts of benzyl alcohol for 24 hours, the glass bead was filtered off, the crystal was washed with 10 parts of methanol, and dried to obtain a novel chlorogallium phthalocyanine crystal having strong diffraction peaks at $2\theta\pm0.2°=7.4°$, 16.6°, 25.5°, and 28.3° measured with a powder X ray diffractive spectrum. This is designated as CG-1.

Synthetic Example 8

To 350 ml of 1-chloronaphthalene were added 50 g of phthalonitrile and 27 g of anhydrous stannic chloride, and they were reacted at 195° C. for 5 hours, after which the product was filtered off, washed with 1-chloronaphthalene, with acetone, with methanol, and with water, and dried in vacuo to obtain 18.3 g of a dichlorotin phthalocyanine crystal. In an agate made pot, 5 g of the resulting dichlorotin phthalocyanine crystal was placed together with 10 g of table salt and 500 g of agate ball (20 mm in diameter), the crystal was pulverized in a planetary ball mill (Type P-5, produced by Fritsch Co.) at 400 rpm for 10 hours, thoroughly washed with water, and then dried. Together with 15 g of THF and 30 g of glass bead (1 mm in diameter), 0.5 g of the crystal was milled at room temperature for 24 hours, the glass bead was filtered off, the crystal was washed with methanol, and dried to obtain a novel dichlorotin phthalocyanine crystal having strong diffractive peaks at $2\theta\pm0.2°=8.5°$, 11.2°, 14.5°, and 27.2° measured with a powder X ray diffractive spectrum. This is designated as CG-2.

Synthetic Example 9

At 0° C., 3 parts of the chlorogallium phthalocyanine crystal obtained in Synthetic Example 7 was dissolved in 60 parts of concentrated sulfuric acid, the solution was added dropwise to 450 parts of distilled water at 5° C. to again separate the crystal. The crystal was washed with distilled water and with an aqueous dilute ammonia, and dried to obtain 2.5 parts of hydroxygallium phthalocyanine crystal. The crystal was pulverized in an automatic mortar for 5.5 hours, 0.5 g of thereof was milled together with 15 parts of dimethylformamide and 30 parts of glass bead having a diameter of 1 mm for 24 hours, the crystal was separated, washed with methanol, and then dried to obtain a novel hydroxygallium phthalocyanine crystal having strong diffractive peaks at 2θ±0.2°=7.5°, 9.9°, 12.5°, 16.3°, 18.6°, 25.1°, and 28.3° measured with a powder X ray diffractive spectrum. This is designated as CG-3.

Synthetic Example 10

To 200 parts of 1-chloronaphthalene were added 30 parts of 1,3-diiminoisoindoline and 17 parts of titanium tetrabutoxide, and they were reacted at 190° C. for 5 hours under an $N_2$ flow, after which the product was filtered off, and washed with an aqueous ammonia, with water, and with acetone to obtain 40 parts of oxytitanium phthalocyanine. In an automatic mortar (Lab-Mill, Type UT-21, produced by Yamato Kagaku K.K.), 5 parts of the resulting titanyl phthalocyanine crystal and 10 parts of sodium chloride were pulverized for 3 hours. Thereafter, the crystal was thoroughly washed with distilled water, and dried to obtain 4.8 parts of titanyl phthalocyanine crystal. The resulting titanyl phthalocyanine crystal showed a clear peak at 2θ±0.2°=27.3° measured with a powder X ray diffractive spectrum. In a mixed solvent comprising 20 parts of distilled water and 2 parts of monochlorobenzene, 2 parts of the resulting titanyl phthalocyanine crystal was stirred at 50° C. for 1 hour, filtered, thoroughly washed with methanol, and dried to obtain a novel titanyl phthalocyanine crystal having a strong diffractive peak at 2θ±0.2°=27.3°. This is designated as CG-4.

Example 1

A solution comprising 10 parts of a zirconium compound (Orgatics ZC540, produced by Matsumoto Seiyaku), 1 part of a silane compound (A 1110, produced by Nippon Unicar), 40 parts of i-propanol, and 20 parts of butanol was coated on an aluminum substrate by an impregnation coating process, and thermally dried at 150° C. for 10 minutes to form a 0.5 μm thick undercoat layer. One part of CG-1 was mixed with 1 part of a polyvinyl butyral resin (Eslec BM-S, produced by Sekisui Chemicals) and 100 parts of n-butyl acetate, and treated together with glass bead by means of a paint shaker for 1 hour to be dispersed, and the resulting coating solution was coated on the undercoat layer by an impregnation coating process, and thermally dried at 100° C. for 10 minutes.

Subsequently, 2 parts of charge transporting copolyester (90) was dissolved in 15 parts of monochlorobenzene, and the resulting coating solution was coated on the aluminum substrate having the charge generating layer formed thereon by an impregnation coating process, and thermally dried at 120° C. for 1 hour to form a 15 μm thick charge transporting layer.

The resulting electrophotographic photoreceptor was evaluated as followed by use of an electrostatic copying paper analyzer (electrostatic analyzer, EPA-8100, manufactured by Kawaguchi Denki K.K.)

The photoreceptor was charged by a corona discharge to −6 kV under an ambient temperature and ambient humidity condition (20° C., 40% RH) and exposed to monochromatic light of 800 nm isolated from the light of a tungsten lamp by a monochromator so as to give energy of 1 $\mu W/cm^2$ on the surface of the photoreceptor. The initial surface potential $V_0$ (V) and the half-decay exposure $E_{1/2}$ ($erg/cm^2$) (energy required for reducing the surface potential by half) were measured. Thereafter, the photoreceptor was irradiated with white light of 10 lux for 1 second, and the residual potential $V_{RP}$ (V) was measured. The same measurement was made after repeating the above-described charging and exposure 1,000 times, and the changes $\Delta V_0$, $\Delta E_{1/2}$ and $\Delta V_{RP}$ were obtained as indications of performance stability and durability. The results obtained are shown in Table 13. In addition, using a photosensitive drum having a photosensitive layer formed on an aluminum pipe in a similar manner, 1,000 sheets were copied with a laser beam printer (produced by Fuji Xerox), and image qualities were evaluated. The results are shown in Table 13.

Examples 2 to 11

Electrophotographic photoreceptors were produced using combinations of charge generating materials with charge transporting materials as shown in Table 13, and were evaluated. The results are shown in Table 13.

Example 12

An electrophotographic photoreceptor was produced in the same manner as in Example 1, except for using 1.2 parts of charge transporting copolyester (93) and 0.8 part of a polycarbonate comprising a repeating structural unit represented by formula (XI) as a binder resin instead of 2 parts of charge transporting copolyester (90), and was evaluated. The results are shown in Table 13.

Comparative Example 1

An electrophotographic photoreceptor was produced in the same manner as in Example 1, except for using 2 parts of PVK instead of 2 parts of charge transporting copolyester (90), and using CG-2 instead of CG-1, and was evaluated. The results are shown in Table 13.

TABLE 13

| | | | Electrophotographic Characteristics | | | | | |
|---|---|---|---|---|---|---|---|---|
| | | | Initial (After 1 Cycle) | | | After Running Test (After 1,000 Cycles) | | |
| Example No. | Charge Transporting Material | Charge Generating Material | $V_O$ (V) | $E_{1/2}$ ($erg/cm^2$) | $V_{RP}$ (V) | $V_O$ (V) | $E_{1/2}$ ($erg/cm^2$) | $V_{RP}$ (V) |
| Example 1 | 90 | CG-1 | −820 | 2.5 | −30 | −805 | 3.2 | −47 |
| Example 2 | 93 | CG-1 | −814 | 2.5 | −22 | −800 | 3.1 | −38 |
| Example 3 | 117 | CG-1 | −804 | 2.6 | −20 | −786 | 3.1 | −35 |

TABLE 13-continued

| | | | | | | | | |
|---|---|---|---|---|---|---|---|---|
| Example 4 | 118 | CG-1 | −828 | 2.6 | −34 | −814 | 3.2 | −49 |
| Example 5 | 93 | CG-2 | −823 | 3.0 | −24 | −809 | 3.5 | −38 |
| Example 6 | 99 | CG-2 | −820 | 3.1 | −24 | −804 | 3.6 | −39 |
| Example 7 | 114 | CG-2 | −819 | 3.1 | −25 | −805 | 3.6 | −40 |
| Example 8 | 90 | CG-3 | −821 | 2.2 | −38 | −806 | 2.5 | −50 |
| Example 9 | 93 | CG-3 | −813 | 2.2 | −24 | −800 | 2.5 | −39 |
| Example 10 | 107 | CG-3 | −814 | 2.2 | −27 | −799 | 2.5 | −44 |
| Example 11 | 93 | CG-4 | −812 | 1.2 | −17 | −799 | 1.4 | −30 |
| Example 12 | 93 + (XI) | CG-1 | −821 | 2.6 | −35 | −802 | 3.2 | −49 |
| Compar. Example 1 | PVK | CG-2 | −834 | 3.4 | −46 | −801 | 4.2 | −76 |

| | Stability | Durability | | |
|---|---|---|---|---|
| Example No. | $\Delta E_{1/2}$ (erg/cm$^2$) | $\Delta V_O$ (V) | $\Delta V_{RP}$ (V) | Image Quality After 1,000 Cycles (Copies) |
| Example 1 | 0.7 | 15 | 17 | Good |
| Example 2 | 0.6 | 14 | 16 | Good |
| Example 3 | 0.5 | 18 | 15 | Slight image diffusion |
| Example 4 | 0.6 | 14 | 15 | Slight fogging |
| Example 5 | 0.5 | 14 | 14 | Good |
| Example 6 | 0.5 | 16 | 15 | Good |
| Example 7 | 0.5 | 14 | 15 | Good |
| Example 8 | 0.3 | 15 | 12 | Good |
| Example 9 | 0.3 | 13 | 15 | Good |
| Example 10 | 0.3 | 15 | 17 | Good |
| Example 11 | 0.2 | 13 | 13 | Good |
| Example 12 | 0.6 | 19 | 14 | Good |
| Compar. Example 1 | 0.8 | 33 | 30 | Total image deficiencies |

The novel charge transporting copolyester according to the present invention can easily be synthesized, excels in solubility and film-forming ability, and can be controlled the ionization potential thereof and, thus, it is effective for various organic electronic devices. As is clear from the results described above, it is useful for forming an electrophotographic photoreceptor having a high photosensitivity and repeating stability.

What is claimed is:

1. An electrophotographic photoreceptor comprising an electroconductive substrate having provided thereon a photosensitive layer, which has a layer containing a charge transporting copolyester containing at least two repeating structural units selected from the group consisting of the structures represented by formulae (I-a) and (I-b):

(I-a)

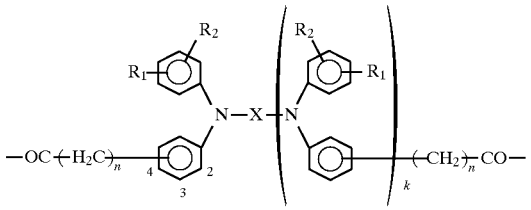

(I-b)

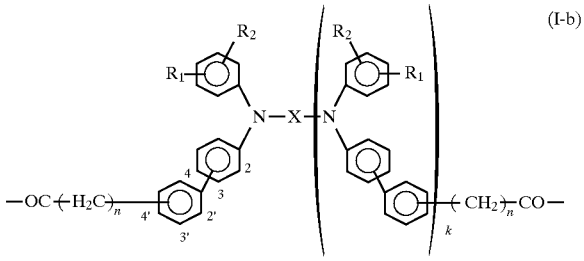

wherein $R_1$ and $R_2$ each independently represents a hydrogen atom, an alkyl group, an alkoxy group, a substituted amino group, a halogen atom, or a substituted or unsubstituted aryl group; X represents a substituted or unsubstituted divalent aromatic residue; n is an integer of from 1 to 5; and k is an integer of 0 or 1.

2. The electrophotographic photoreceptor as claimed in claim 1, wherein the layer containing a charge transporting copolyester at least two repeating structural units selected from the group consisting of structures represented by formulae (I-a) and (I-b) is an outermost layer of the electrophotographic photoreceptor.

3. The electrophotographic photoreceptor as claimed in claim 1, wherein the charge transporting copolyester comprises:

(1) said at least two repeating structural units selected from the group consisting of the structures represented by formulae (I-a) and (I-b) as dibasic carboxylic acid components and a repeating structural unit represented by formula (III) as a dihydric alcohol component, wherein the charge transporting copolyester has terminal groups each represented by formula (IV-a) or (IV-b) and has a polymerization degree of from 5 to 5,000; or (2) said at least two repeating structural units selected from the group consisting of the structures represented by formulae (I-a) and (I-b), and a repeating structural unit represented by formula (II) as dibasic carboxylic acid components; and a repeating structural unit represented by formula (III) as a dihydric alcohol component, wherein the charge transporting copolyester has terminal groups each represented by formula (IV-a) or (IV-b) and has a polymerization degree of from 5 to 5,000:

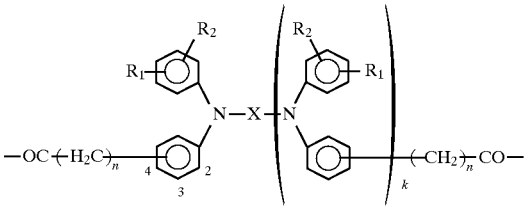

(I-a)

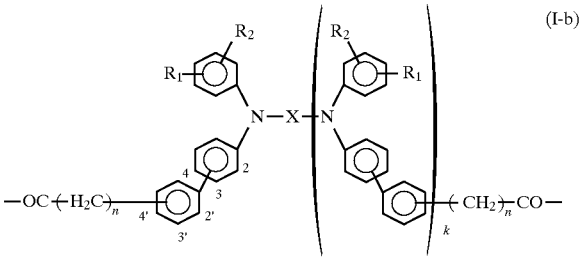

(I-b)

$$—O(—Z—CO— \quad \text{(II)}$$

$$—O—(Y—O)_m— \quad \text{(III)}$$

$$—O—(Y—O)_m—R \quad \text{(IV-a)}$$

$$—O—(Y—O)_m—CO—Z—CO—OR' \quad \text{(IV-b)}$$

wherein $R_1$ and $R_2$ each independently represents a hydrogen atom, an alkyl group, an alkoxy group, a substituted amino group, a halogen atom or a substituted or unsubstituted aryl group; X is a substituted or unsubstituted divalent aromatic group; Z is a divalent carboxylic acid residue; R and R' each independently represents a hydrogen atom, an alkyl group, a substituted or unsubstituted aryl group, or a substituted or unsubstituted aralkyl group; Y is a divalent alcohol residue; n is an integer of from 1 to 5; k is an integer of 0 or 1; and m is an integer of from 1 to 5.

4. The electrophotographic photoreceptor as claimed in claim 1, wherein X in formulae (I-a) and (I-b) is represented by formula (V-a) or (V-b):

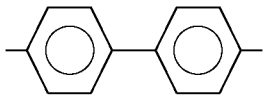

(V-a)

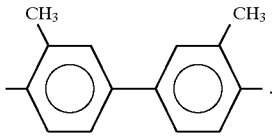

(V-b)

5. The electrophotographic photoreceptor as claimed in claim 4, wherein X in formulae (I-a) and (I-b) is represented by formula (V-b).

6. The electrophotographic photoreceptor as claimed in claim 1, wherein said photosensitive layer contains:

(1) a charge transporting copolyester containing at least two repeating structural units selected from the group consisting of the structures represented by formulae (I-a) and (I-b) as a charge transporting material; and (2) at least one selected from the group consisting of a halogenated gallium phthalocyanine crystal, a halogenated tin phthalocyanine crystal, a hydroxygallium phthalocyanine crystal and a titanyl phthalocyanine crystal as a charge generating material.

7. The electrophotographic photoreceptor as claimed in claim 6, wherein said photosensitive layer further contains at least one polymer which is compatible with the charge transporting copolyester.

* * * * *